US009038253B2

(12) United States Patent
Herbold et al.

(10) Patent No.: US 9,038,253 B2
(45) Date of Patent: May 26, 2015

(54) SYSTEM AND METHOD FOR LIFTING A CASING SECTION

(75) Inventors: John William Herbold, Fountain Inn, SC (US); Randall Stephen Corn, Travelers Rest, SC (US); James Bradford Holmes, Founain Inn, SC (US); Charles V. Spanos, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1013 days.

(21) Appl. No.: 13/097,655

(22) Filed: Apr. 29, 2011

(65) Prior Publication Data

US 2012/0272496 A1 Nov. 1, 2012

(51) Int. Cl.

| | |
|---|---|
| ***B25B 27/02*** | (2006.01) |
| ***F01D 25/28*** | (2006.01) |
| ***B66C 1/10*** | (2006.01) |

(52) U.S. Cl.

CPC ..... *F01D 25/285* (2013.01); *Y10T 29/49721* (2015.01); *Y10T 29/53* (2015.01); *B66C 1/107* (2013.01); *F05D 2230/72* (2013.01); *F05D 2230/68* (2013.01)

(58) Field of Classification Search

USPC ..... 29/235, 270, 278, 255, 281.1; 254/93 R, 254/133 R, 134, 2 B

See application file for complete search history.

(56) References Cited

U.S. PATENT DOCUMENTS

| | | | | |
|---|---|---|---|---|
| 5,653,012 | A * | 8/1997 | Pasternak et al. | 29/281.4 |
| 5,970,666 | A | 10/1999 | Kurabayashi et al. | |
| 6,145,813 | A | 11/2000 | Anderson | |
| 6,182,343 | B1 * | 2/2001 | Haes et al. | 29/235 |
| 6,746,183 | B1 * | 6/2004 | Sullivan | 405/272 |
| 7,264,226 | B2 * | 9/2007 | Smith et al. | 254/93 R |
| 7,367,075 | B2 | 5/2008 | Kim | |
| 7,490,813 | B1 * | 2/2009 | Weddle | 254/93 R |
| 2006/0101643 | A1 | 5/2006 | Adinarayana et al. | |
| 2010/0162726 | A1 | 7/2010 | Robertson et al. | |

FOREIGN PATENT DOCUMENTS

DE 19821889 A1 11/1999

OTHER PUBLICATIONS

Related U.S. Appl. No. 12/964,312, filed Dec. 9, 2010.

Search Report from EP Application No. 12165653.2 dated Nov. 5, 2013.

Unofficial English Translation of Chinese Office Action issued in connection with CN Application No. 201210146097.8 on Dec. 29, 2014.

* cited by examiner

*Primary Examiner* — Lee D Wilson

(74) *Attorney, Agent, or Firm* — Dority & Manning, P.A.

(57) ABSTRACT

A system for lifting a first casing section relative to a second casing section is disclosed. The system may generally include a guide member configured to be coupled to the second casing section so as to generally extend lengthwise in a lift direction of the first casing section and a sleeve member configured to be coupled to the first casing section. The sleeve member may be movably disposed on the guide member such that the sleeve member is displaced along a length of the guide member as the first casing section is lifted in the lift direction.

14 Claims, 6 Drawing Sheets

SYSTEM AND METHOD FOR LIFTING A CASING SECTION

FIELD OF THE INVENTION

The present subject matter relates generally to casings for industrial equipment such as turbines, generators, motors and compressors and, more particularly, to a system and method for lifting a first casing section relative to a second casing section.

BACKGROUND OF THE INVENTION

Numerous types of industrial equipment include heavy casings surrounding moving and/or rotating components. For example, a typical gas turbine may include a turbine section having alternating stages of fixed nozzles and rotating buckets and a turbine casing generally surrounding the turbine section in order to contain the hot gases of combustion flowing past the various stages of nozzles and buckets.

When a maintenance operation needs to be performed on a gas turbine, it is often necessary that a section of the turbine casing be removed. For example, it is common to remove the upper half of a turbine casing to allow maintenance workers to inspect and/or replace nozzles/buckets and/or to perform various other scheduled maintenance operations. Typically, this requires the use of heavy lifting equipment, such as a crane. Unfortunately, even with the use of suitable heavy lifting equipment, the removal of the upper half of the turbine casing can still be a very dangerous undertaking. In particular, due to the large mass of a typical casing section, the slightest lateral acceleration can create a tremendous amount of force. Thus, the occurrence of an unforeseen event, such as an earthquake, equipment failure and the like, can result in significant damage to the turbine and/or significant injuries to nearby maintenance workers.

Accordingly, a system and method for lifting a casing section that provides an enhanced degree of safety would be welcomed in the art.

BRIEF DESCRIPTION OF THE INVENTION

Aspects and advantages of the invention will be set forth in part in the following description, or may be obvious from the description, or may be learned through practice of the invention.

In one aspect, the present subject matter discloses a system for lifting a first casing section relative to a second casing section. The system may generally include a guide member configured to be coupled to the second casing section so as to generally extend lengthwise in a lift direction of the first casing section and a sleeve member movably disposed on the guide member. The sleeve member may be configured to be coupled to the first casing section such that the sleeve member is displaced in the lift direction as the first casing section is lifted. Additionally, the system may include a retention device configured to be coupled to the guide member at differing locations along a length of the guide member.

In another aspect, the present subject matter discloses a system for lifting a first casing section relative to a second casing section. The system may generally include a guide member configured to be coupled to the second casing section so as to generally extend lengthwise in a lift direction of the first casing section and a sleeve member configured to be coupled to the first casing section. The sleeve member may be movably disposed on the guide member such that the sleeve member is displaced along a length of the guide member as the first casing section is lifted in the lift direction.

In a further aspect, the present subject matter discloses a method for lifting a first casing section relative to a second casing section. The method may include coupling a sleeve member to the first casing section, coupling a guide member to the second casing section, wherein the sleeve member is movably disposed on the guide member, lifting the first casing section relative to the second casing section in a lift direction and coupling a retention device to the guide member as the sleeve member is displaced in the lift direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
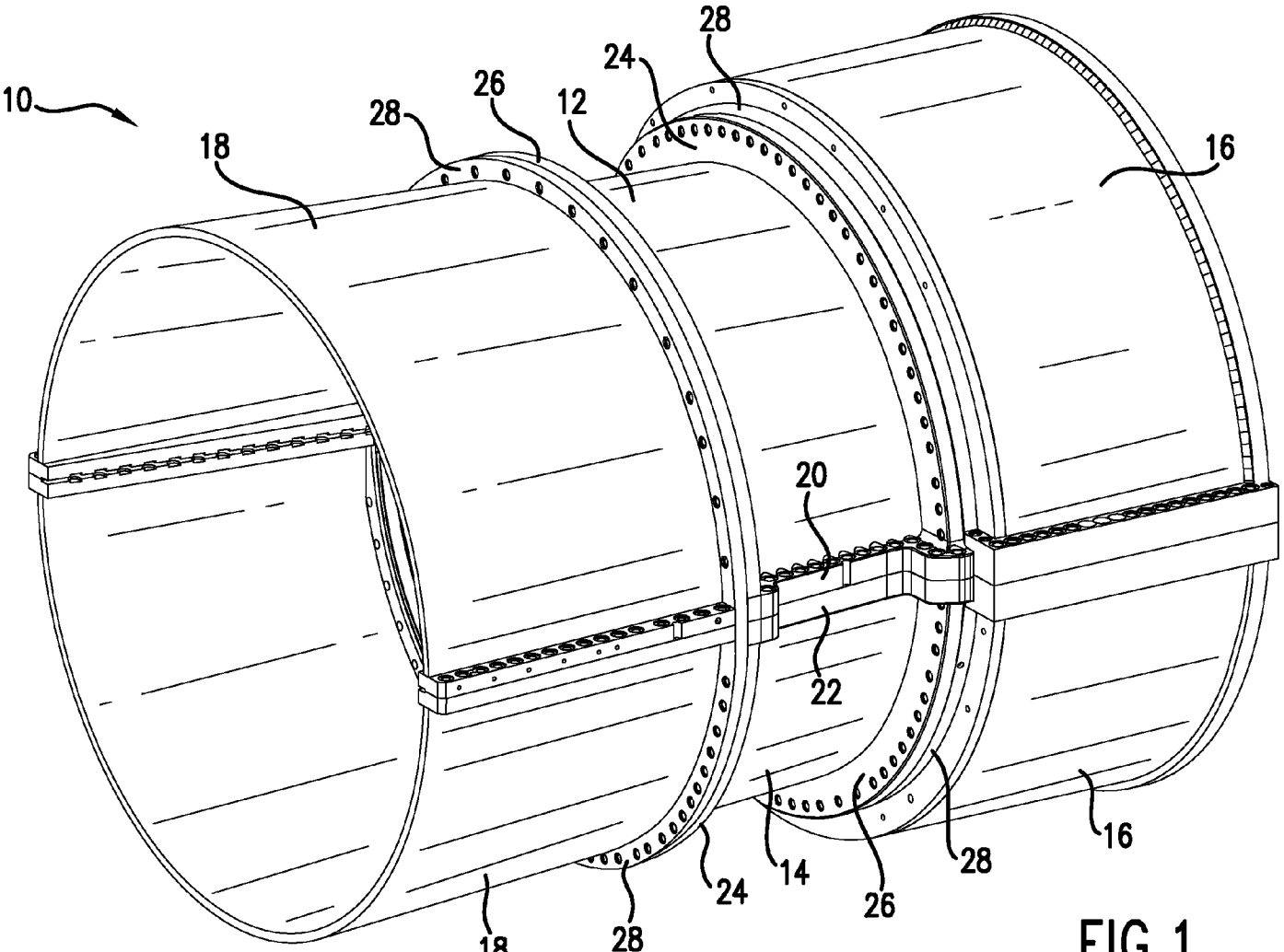
FIG. 1 illustrates a perspective view of one embodiment of a casing assembly in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system for lifting a first casing section relative to a second casing section. In particular, the present subject matter discloses a support assembly configured to limit the non-vertical displacement (e.g., the axial and/or lateral displacement) of the first casing section as it is lifted relative to the second casing section. For example, in one embodiment, the support assembly may include mating male and female components configured to be attached to the first and second casing sections so as to guide the first casing section in the vertical direction. As such, the potential for any non-vertical displacements of the first casing section due to an unforeseen event, such as an earthquake, may be minimized. Additionally, the support assembly may also be configured to vertically support the weight of the first casing section in the event of equipment failure, thereby preventing the first casing section from falling and damaging/injuring the second casing section and/or nearby workers.

Referring now to the drawings, FIG. 1 illustrates a perspective view of one embodiment of a casing assembly 10. In general, the casing assembly 10 may include a plurality of casing sections 12, 14, 16, 18 assembled together to form an encasing structure. For example, as shown, the casing assembly 10 includes an upper, first casing section 12 configured to be attached to a lower, second casing section 14. In particular, the first casing section 12 may include a horizontal flange 20 configured to be attached to a corresponding horizontal flange 22 of the second casing 14 section using any suitable means, such as by using a plurality bolts or other suitable fasteners or by welding the flanges 20, 22 to one another. Additionally, the first and second casing sections 12, 14 may also be configured to be attached to any adjacent casing sections 16, 18 of the casing assembly 10. For instance, as shown in the illustrated embodiment, the first and second casing sections 10, 12 may each include a forward vertical flange 24 and an aft vertical flange 26 configured to be attached to corresponding vertical flanges 28 of adjacent forward and aft casing sections 16, 18, respectively.

It should be appreciated that the casing assembly 10 may generally be configured as the casing for any suitable industrial equipment. However, in several embodiments of the present subject matter, the casing assembly 10 may be configured as the turbine casing for a gas turbine, such as by being be configured to surround or encase any rotating components of the turbine rotor (e.g., a plurality of turbine buckets extending from a plurality of rotor wheels). In such embodiments, the first casing section 12, for example, may comprise a casing section of the upper half of the turbine casing and the second casing section 14 may comprise a casing section of the lower half of the turbine casing. As such, when the turbine is operating, the first casing section 12 may be coupled to the second casing section 14 to contain the hot gases of combustion flowing past the rotating components of the turbine rotor.

Figure 2:
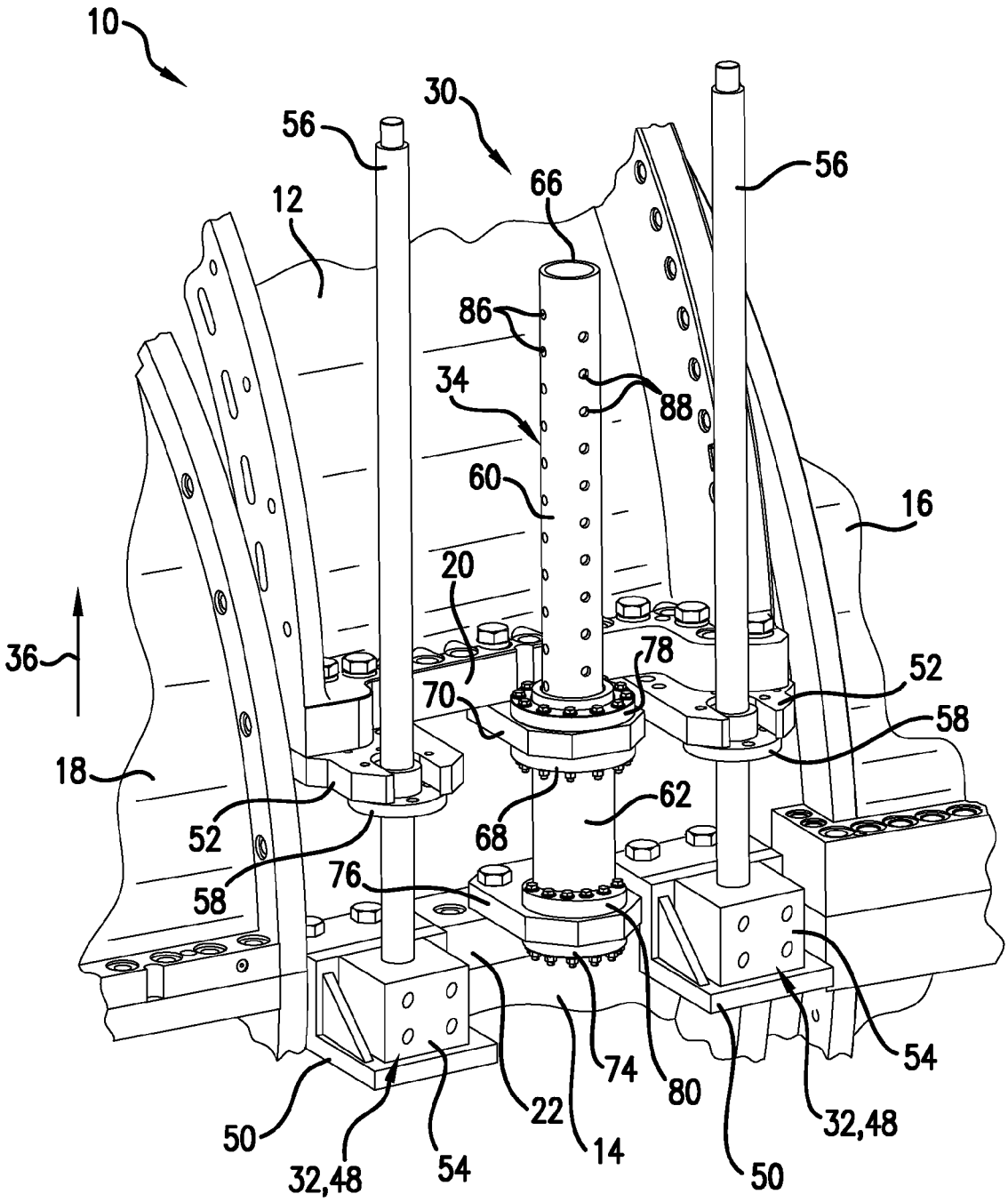
FIG. 2 illustrates a partial, perspective view of one embodiment of a system for lifting a first casing section relative to a second casing section in accordance with aspects of the present subject matter, particularly illustrating embodiments of a lifting mechanism and a support assembly of the system.
Figure 3:
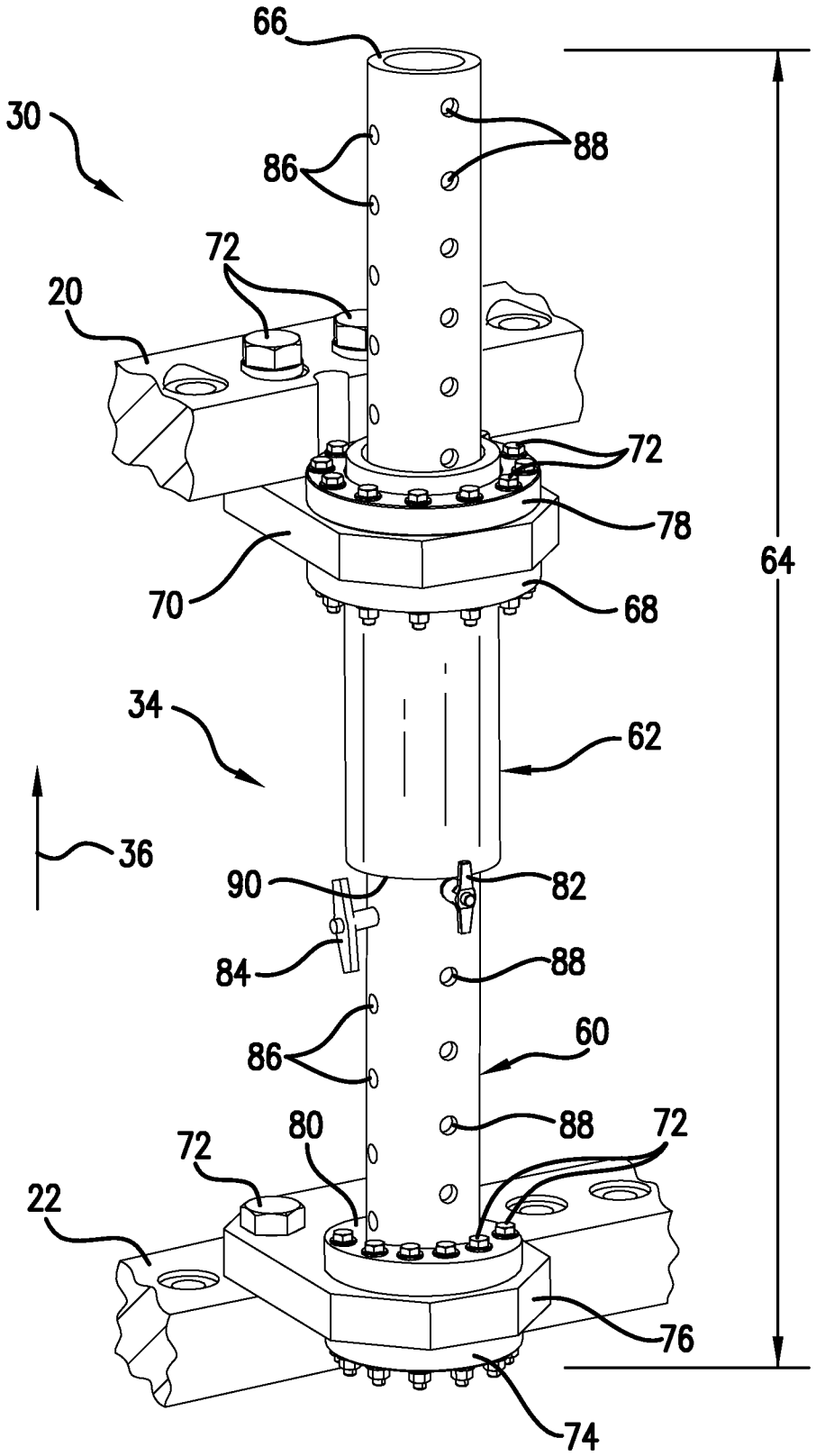
FIG. 3 illustrates a perspective, close-up view of the support assembly shown in FIG. 2.

Referring now to FIGS. 2 and 3, there is illustrated one embodiment of a system 30 for lifting the first casing section 12 relative to the second casing section 14. In particular, FIG. 2 illustrates a perspective view of the system 30, particularly illustrating one embodiment of a lifting mechanism 32 and a support assembly 34 of the system 30. Additionally, FIG. 3 illustrates close-up view of the support assembly 34 shown in FIG. 2.

As shown, the system 30 generally includes at least one lifting mechanism 32 for lifting the first casing section 12 in a vertical or lift direction (indicated by arrow 36) relative to the second casing section 14. In general, the lifting mechanism 32 may comprise any suitable device, mechanism and/or structure configured to permit the first casing section 12 to be lifted to a useful height for performing maintenance operations within the casing assembly or for installing one or more support members 38, 40, 42, 44 (FIG. 4) and/or travel beams 46 (FIG. 5) between the first casing section 12 and the second casing section 14 and/or between the first casing section 12 and other adjacent casing sections 16, 18. Thus, in several embodiments, the lifting mechanism 32 may comprise one or more raising devices 48 coupled to the first and second casing sections 12, 14. Suitable raising devices 48 for lifting the first casing section 12 relative to the second casing section 14 are disclosed in U.S. application Ser. No. 12/964,312 entitled "Casing Section Lift and Transport System" filed on Dec. 12, 2010 and assigned to the General Electric Company. For example, in the illustrated embodiment, each raising device 48 includes a first attachment member 50 rigidly attached to a portion the first casing section 12 (e.g., the horizontal flange 20) and a second attachment member 52 rigidly attached to a portion of the second casing section 14 (e.g., the horizontal flange 22). Additionally, each raising device 48 may include a jacking mechanism 54 configured to be supported by and/or coupled to the second attachment member 52 such that the jacking mechanism 54 may be employed to displace the first casing section 12 in the lift direction relative to the second casing section 14. For instance, in one embodiment, the jacking mechanism 54 may be configured as a screw jack and may include a rotatable lead screw 56 and a collar 58 configured to mate with and/or be coupled to the first attachment member 50. As is generally known in the art, the lead screw 56 may be configured to be rotated about its axis in order to cause the collar 58 to move up or down along the length of the lead screw 56. Thus, due to the engagement of the collar 58 with the first attachment member 50, the first casing section 12 may be displaced in the lift direction as the lead screw 56 is rotated. Of course, it should be appreciated that, in alternative embodiments, the jacking mechanism 54 may comprise any other suitable type of jacking mechanism known in the art and, thus, need not be limited to a screw jack.

Additionally, as shown in the illustrated embodiment, two raising devices 48 may be installed on one side of the first and second casing sections 12, 14 and, although not shown, two raising devices 48 may also be installed on the other side of the casing sections 12, 14. However, in alternative embodiments, any other suitable number of raising devices 48 may be installed on each side of the casing sections 12, 14. For example, in one embodiment, a single raising device 48 may be installed on each side of the casing sections 12, 14. Alternatively, more than two raising devices 48 may be installed on each side of the casing sections 12, 14.

Moreover, it should be appreciated that, in other embodiments, the lifting mechanism 32 may comprise any other suitable device, mechanism and/or structure for lifting the first casing section 12 relative to the second casing section 14. For instance, the lifting mechanism 32 may comprise a crane or any other suitable type of lifting equipment.

Referring still to FIGS. 2 and 3, the system 30 may also include a support assembly 34 configured to absorb any non-vertical loads (e.g., axial and/or lateral loads) acting on the first casing section 12 as it is lifted relative to the second casing section 14. For example, in several embodiments, the support assembly 34 may include a guide member 60 coupled to the second casing section 14 and a sleeve member 62 coupled to the first casing section 12. The guide member 60 may generally comprise an elongated male component configured to extend lengthwise in the lift direction. Similarly, the sleeve member 62 may generally comprise a female component configured to be movably disposed and/or received on the guide member 60. Thus, as the first casing section 12 is lifted, the displacement of the sleeve member may be guided in the lift direction along a length 64 of the guide member 60. As such, the support assembly 30 may generally serve to limit the non-vertical movement (e.g., axial and/or lateral movement) of the first casing section 12 as it is lifted relative to the second casing section 14.

As shown in the illustrated embodiment, a single support assembly 34 may be installed on one side of the first and second casing sections 12, 14 and, although not shown, another support assembly 34 may be installed on the other side of the casing sections 12, 14. However, it should be appreciated that, in alternative embodiments, more than one support assembly 34 may be installed on each side of the casing sections 12, 14.

The guide and sleeve members 60, 62 of the support assembly 34 may generally have any suitable shape and/or configuration that permits the sleeve member 62 to be movably disposed and/or received on the guide member 60. Thus, in several embodiments, the sleeve member 62 may be configured to surround or encase a portion of the guide body 60. For example, as shown in the illustrated embodiment, both the guide and sleeve members 60, 62 may have tubular configuration and may each define a generally circular cross-sectional shape. In such an embodiment, the outer diameter of the guide member 60 and the inner diameter of the sleeve member 62 may generally be chosen so that the sleeve member 62 may be displaced relative to the guide member 60 as the first casing section 12 is lifted. For instance, the diameters may be chosen so that a small clearance gap (not shown) is defined between the guide member 60 and sleeve member 62. As such, the sleeve member 62 may be received or installed at one end of the guide member 60 (e.g., a top end 66 of the guide member 60) and may be freely moved in the lift direction along the length 64 of the guide member 60.

In other embodiments, the guide and sleeve members 60, 62 may have any other suitable shape that permits the sleeve member 62 to be movably disposed and/or received on the guide member 60. For instance, instead of the circular cross-sectional shape described above, the guide and sleeve members 60, 62 may both define corresponding triangular, rectangular or other suitable cross-sectional shapes. Additionally, in further embodiments, the sleeve member 62 need not be configured to encase or surround the guide member 60, but may generally have any other suitable configuration that allows the sleeve member 60 to be movably disposed and/or received on the guide member 60 as the first casing section 12 is lifted. For example, in one embodiment, the sleeve member 62 may include a plurality of wheels, rollers or other suitable rotational devices configured to engage and/or fit into portions of the guide member 60 (e.g., grooves, slots and/or channels defined in the guide member 60) as the first casing section 12 is lifted relative to the second casing section 14.

Referring still to FIGS. 2 and 3, it should be appreciated that the sleeve member 62 may generally be configured to be coupled to the first casing section 12 using any suitable means. Thus, in several embodiments, a circumferential sleeve flange 68 may extend outwardly from the outer perimeter of the sleeve member 62 and may be configured to be coupled to a portion of the first casing section 12. For example, in one embodiment, the sleeve flange 68 may be directly coupled to the first casing section 12, such as by securing the sleeve flange 68 to the horizontal flange 20 of the first casing section 12 using bolts or other suitable fasteners or by welding the sleeve flange 68 to the horizontal flange 20.

Alternatively, the sleeve flange 68 may be indirectly coupled to the first casing section 12. For instance, as shown in the illustrated embodiment, a first mounting plate 70 may be installed between the sleeve flange 68 and the first casing section 12. In general, the first mounting plate 70 may comprise any suitable rigid support/structural member configured to be attached to both the first casing section 12 and the sleeve flange 68. For example, as shown in FIG. 3, in one embodiment, the first mounting plate 70 may be rigidly attached between the horizontal flange 20 of the first casing section 12 and the sleeve flange using bolts 72 or other suitable fasteners. In other embodiments, the first mounting plate 70 may be rigidly attached between the horizontal flange 20 and the sleeve flange 68 using any other suitable means known in the art, such as by welding the first mounting plate 70 to portions of both the horizontal flange 20 and the sleeve flange 68.

Similarly, the guide member 60 may be configured to be coupled to the second casing section 14 using any suitable means. Thus, in several embodiments, a circumferential guide flange 74 may extend outwardly from the outer perimeter of the guide member 60 and may be configured to be coupled to a portion of the second casing section 14. For example, in one embodiment, the guide flange 74 may be directly coupled to the second casing section 14, such as by securing the guide flange 74 to the horizontal flange 22 of the second casing section 14 using bolts or other suitable fasteners or by welding the guide flange 74 to the horizontal flange 22.

Alternatively, the guide flange 74 may be indirectly coupled to the second casing section 14. For instance, as shown in the illustrated embodiment, a second mounting plate 76 may be installed between the guide flange 74 and the second casing section 14. In general, the second mounting plate 76 may comprise any suitable rigid support/structural member configured to be attached to both a portion of the second casing section 14 and the guide flange 74. For example, as shown in FIG. 3, in one embodiment, the second mounting plate 76 may be rigidly attached between the horizontal flange 22 of the second casing section 14 and the guide flange 74 using bolts 72 or other suitable fasteners. In other embodiments, the second mounting plate 76 may be rigidly attached between the horizontal flange 22 and the guide flange 74 using any other suitable means known in the art, such as by welding the second mounting plate 76 to portions of both the horizontal flange 22 and the guide flange 74.

It should be appreciated that, in several embodiments, the sleeve and guide flanges 68, 74 may be formed integrally with the sleeve and guide members 60, 62, respectively, such as by casting or machining such features as a single component. Alternatively, the sleeve and guide flanges 68, 74 may comprise separate components and may be configured to be separately attached to the sleeve and guide members 60, 62, respectively. For example, in one embodiment, the sleeve and guide flanges 68, 74 may be welded to the sleeve and guide members 60, 62. In such an embodiment, the sleeve and guide flanges 68, 74 may include suitable weld preparation features to enhance capability of transferring loads at the welded attachment. For instance, the sleeve and guide flanges 68, 74 may include one or more tapered or chamfered surfaces (not shown) configured to extend adjacent to the outer perimeters of the sleeve and guide members 68, 74, respectively, so that a groove weld may be created between such components.

Additionally, it should also be appreciated that, in embodiments in which the sleeve and guide flanges 68, 74 are to be attached to the first and second mounting plates 70, 76, respectively, using bolts 72 and/or other suitable fasteners, the support assembly 34 may also include one or more spacer rings 78, 80 configured to be similarly attached to the mounting plates 70, 76. For example, as shown in FIG. 2, a first spacer ring 78 may be disposed opposite the sleeve flange 68 so that the bolts 72 or other suitable fasteners may be secured through the sleeve flange 68, the first mounting plate 70 and the first spacer ring 78 when the sleeve member 62 is coupled to the first casing section 12. Similarly, a second spacer ring 80 may be disposed opposite the guide flange 74 so that the bolts 72 or other suitable fasteners may be secured through the guide flange 74, the second mounting plate 76 and the second spacer ring 80 when the guide member 60 is coupled to the second casing section 14.

Referring particularly to FIG. 3, in addition to being configured to limit the non-vertical displacement of the first casing section 12 as is it lifted relative to the second casing section 14, the support assembly 34 may also be configured as a safety device to prevent the first casing section 12 from falling onto the second casing section 14. Thus, in several embodiments, the support assembly 34 may include at least one retention device 82, 84 configured to be coupled to the guide member 60 at differing locations along its length 64 in order to provide a means for supporting the weight of the first casing section 12 in the event of failure of the lifting mechanisms 32.

For instance, in one embodiment, the retention device 82, 84 may comprise one or more shear pins, such as a first shear pin 82 and a second shear pin 84, configured to be received in and/or through portions of the guide member 60 as the first casing section 12 is lifted. Specifically, as shown in the illustrated embodiment, a plurality of openings 86, 88 may be defined in the guide member 60 for receiving the shear pins 82, 84. The openings 86, 88 may generally be defined in the guide member 60 so as to be spaced apart in the lift direction along the guide member's length 64. Additionally, in a particular embodiment of the present subject a matter, at least a portion of the openings 86, 88 may be circumferentially offset from another portion of the openings 86, 88. For instance, as shown in FIG. 3, the guide member 60 may include a first set of vertically aligned openings 86 and a second set of vertically aligned openings 88, with the first set of openings 86 being circumferentially offset from the second set of openings 88 by suitable offset angle (e.g., ninety degrees).

By spacing the openings 86, 88 apart along the length 64 of the guide member 60, it should be appreciated that the position of the shear pins 82, 84 may be adjusted as the sleeve member 62 is vertically displaced along the guide member 60. For example, in one embodiment, the position of the shear pins 82, 84 may be continuously adjusted as the sleeve member 62 is displaced vertically so that the first and second shear pins 82, 84 are always located in the two openings disposed closest to a bottom end 90 of the sleeve member 62. In other words, the shear pins 82, 84 may be continuously leapfrogged as the first casing section 12 is lifted to maintain their position adjacent to the bottom end 90 of the sleeve member 62. One of ordinary skill in the art should appreciate that, by using at least two shear pins 82, 84, it can be ensured that a shear pin 82, 84 is always installed within the guide member 60 as the first casing section 12 is lifted. However, in alternative embodiments, the support assembly 34 may simply include a single shear pin configured to be inserted in and/or through the openings 86, 88.

It should also be appreciated that, in other embodiments, the retention device 82, 84 may comprise any other suitable device configured to be coupled to the guide member 60 at differing locations along its length 64 in order to provide a means for supporting the weight of the first casing section 12 in the event of failure of the lifting mechanisms 32. For instance, the retention device 82, 84 may comprise one or more collars, rings, sleeves, brackets, fasteners and/or any other suitable structure that may be coupled to the guide member 60 along its length 64 to provide vertical support for the first casing section 12.

Figure 4:
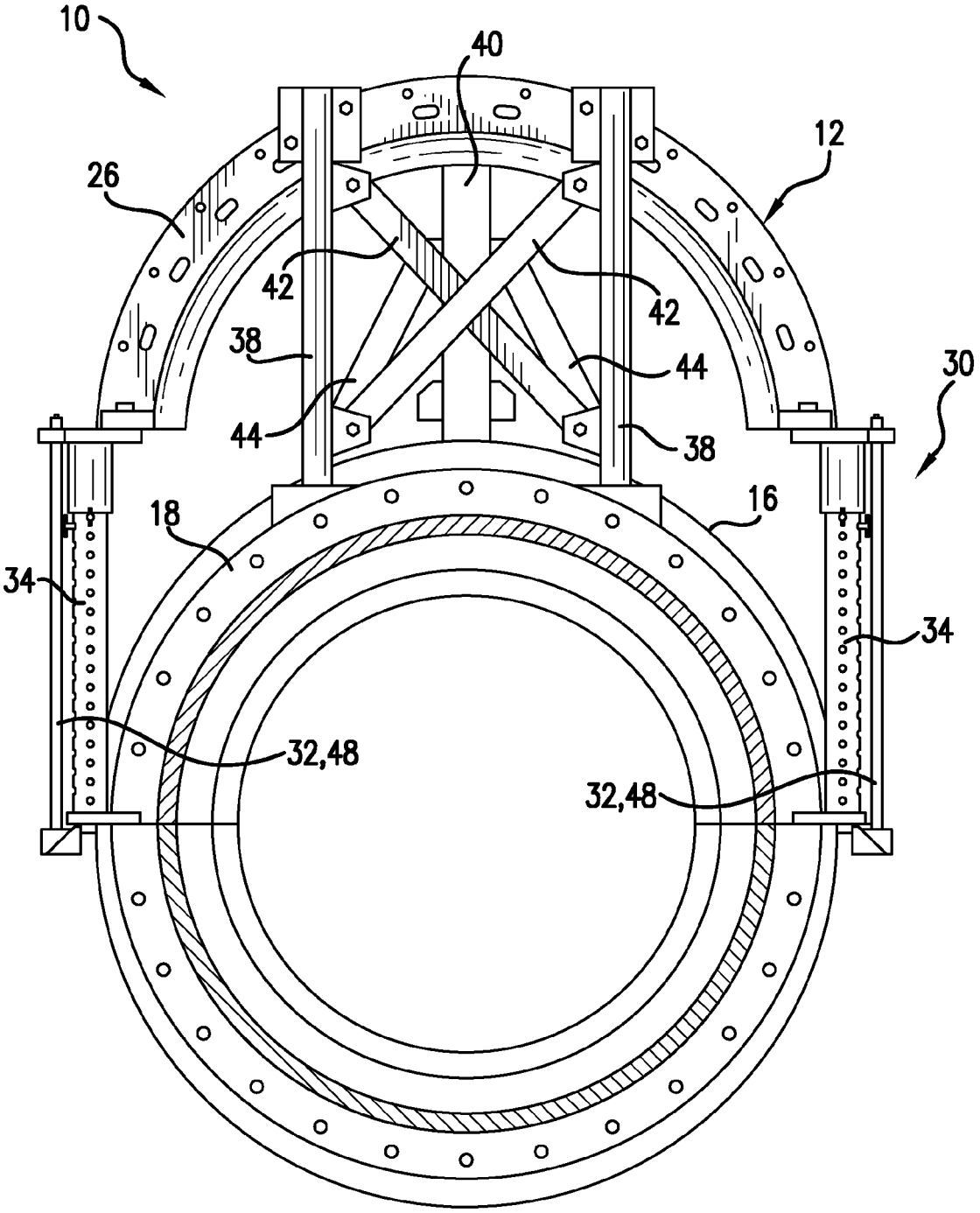
FIG. 4 illustrates a rear view of the casing assembly shown in FIG. 1 with a first casing section of the casing assembly being in a lifted position, particularly illustrating embodiments of support members that may be installed between the first casing section and any adjacent casing sections of the casing assembly.

Referring now to FIG. 4, there is illustrated a rear view of the casing assembly 10 shown in FIGS. 1-3, particularly illustrating the first casing section 12 in a lifted position. As shown, in several embodiments of the present subject matter, the disclosed system 30 may also include one or more support members 38, 40, 42, 44 configured to be mounted between the first casing section 12 and one or more adjacent casing sections 14, 16, 18 after the first casing section 12 has been lifted to a predetermined position. For instance, in one embodiment, the support members 38, 40, 42, 44 may be installed between the first casing section 12 and any adjacent casing sections 14, 16, 18 in order to provide additional vertical support for the first casing section 12 while maintenance operations are being performed inside the casing assembly 10, while the support assemblies 34 are removed from the first and second casing sections 12, 14 and/or while any other features of the disclosed system (e.g., the travel beam 46 (FIG. 5)) are installed and/or removed.

In general, the support members 38, 40, 42, 44 may comprise any suitable structural members (e.g., I-beams or other suitable support beams) and may be arranged in any suitable manner that permits the supports members 38, 40, 42, 44 to function as described herein. For instance, as shown in the illustrated embodiment, a pair of aft vertical supports 38 may be mounted between the aft vertical flange 26 of the first casing section 12 and a portion of an adjacent aft casing section 18 and a forward vertical support 40 may be mounted between the forward vertical flange 24 (FIG. 1) of the first casing section 12 and a portion of an adjacent forward casing section 16. Additionally, one or more cross support members 42 may be mounted between the aft vertical supports 38 and one or more side support members 44 may be mounted between the forward vertical support 40 and the adjacent forward casing section 16. Of course, it should be appreciated that, in alternative embodiments, the disclosed system 30 may include any other suitable number of support members 38, 40, 42, 44 having any other suitable arrangement between the first casing section 12 and any adjacent casing sections 14, 16, 18. For example, in another embodiment, one or more additional support members (not shown) may be mounted between the forward and aft vertical supports 40, 38.

Figure 5:
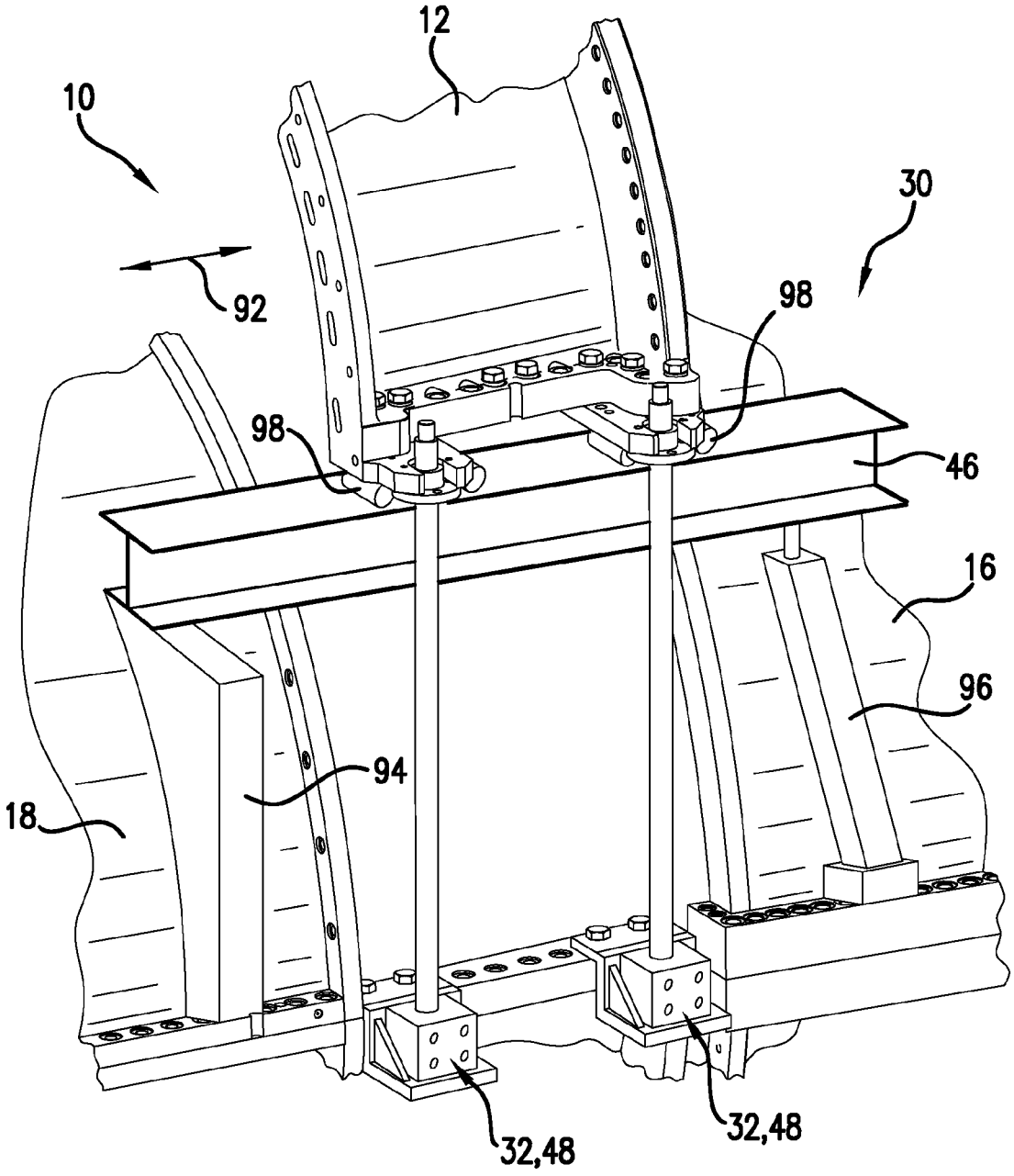
FIG. 5 illustrates a partial perspective view of one embodiment of a travel beam that may be utilized to axially translate a first casing section of the disclosed casing assembly in accordance with aspects of the present subject matter.

Referring now to FIG. 5, a perspective view of another embodiment of the disclosed system 30 is illustrated in accordance with aspects of the present subject matter, particularly illustrating a travel beam 46 that may be utilized to displace the first casing section 12 in an axial direction (indirect by arrow 92). In general, the travel beam 46 may be configured to extend axially between one or more vertical beam supports 94, 96 so as to define an axial travel path for the first casing section 12. For example, as shown in FIG. 5, first and second vertical beam supports 94, 96 may be arranged on and/or attached to adjacent casing sections 16, 18 to provide vertical support for the travel beam 46. Similarly, a corresponding set of vertical supports 94, 96 may also be arranged on an opposite side of the casing assembly 10 to provide vertical support for an additional travel beam 46.

It should be appreciated that, in several embodiments, the illustrated travel beam 46 may be configured to be installed after the support members 38, 40, 42, 44 described above with reference to FIG. 4 have been mounted between the first casing section 12 and any adjacent casing sections 14, 16, 18. For example, in a particular embodiment of the present subject matter, suitable steps for lifting the first casing section 12 and installing the travel beam 46 may include: installing the raising devices 48 on the first and second casing sections 12, 14, installing the support assemblies 34 on the first and second casing sections 12, 14, lifting the first casing section 12 to a predetermined position, installing the support members 38, 40, 42, 44 between the first casing section 12 and any adjacent casing sections 14, 16, 18, removing the support assemblies 34 and installing the travel beam 46. Once the travel beam 46 is installed, the support members 38, 40, 42, 44 may then be removed to allow the first casing section 12 to be lowered onto the travel beam 46. The raising devices 48 may then be decoupled from the first casing section 12 to permit the first casing section 12 to be translated axially along the length of the travel beam 46.

Additionally, in several embodiments, it should be appreciated that a suitable translation device or mechanism 98 may be disposed at the interface defined between the first casing section 12 and the travel beam 46 to facilitate translating the first casing section 12 along the length of the travel beam 46. For example, in one embodiment, a linear bearing may be disposed at the interface between the first casing section 12 and the travel beam 46. Alternatively, one or more rollers may be disposed between the first casing section 12 and the travel beam 46 to allow the casing section 12 to be displaced axially across the travel beam 46.

Figure 6:
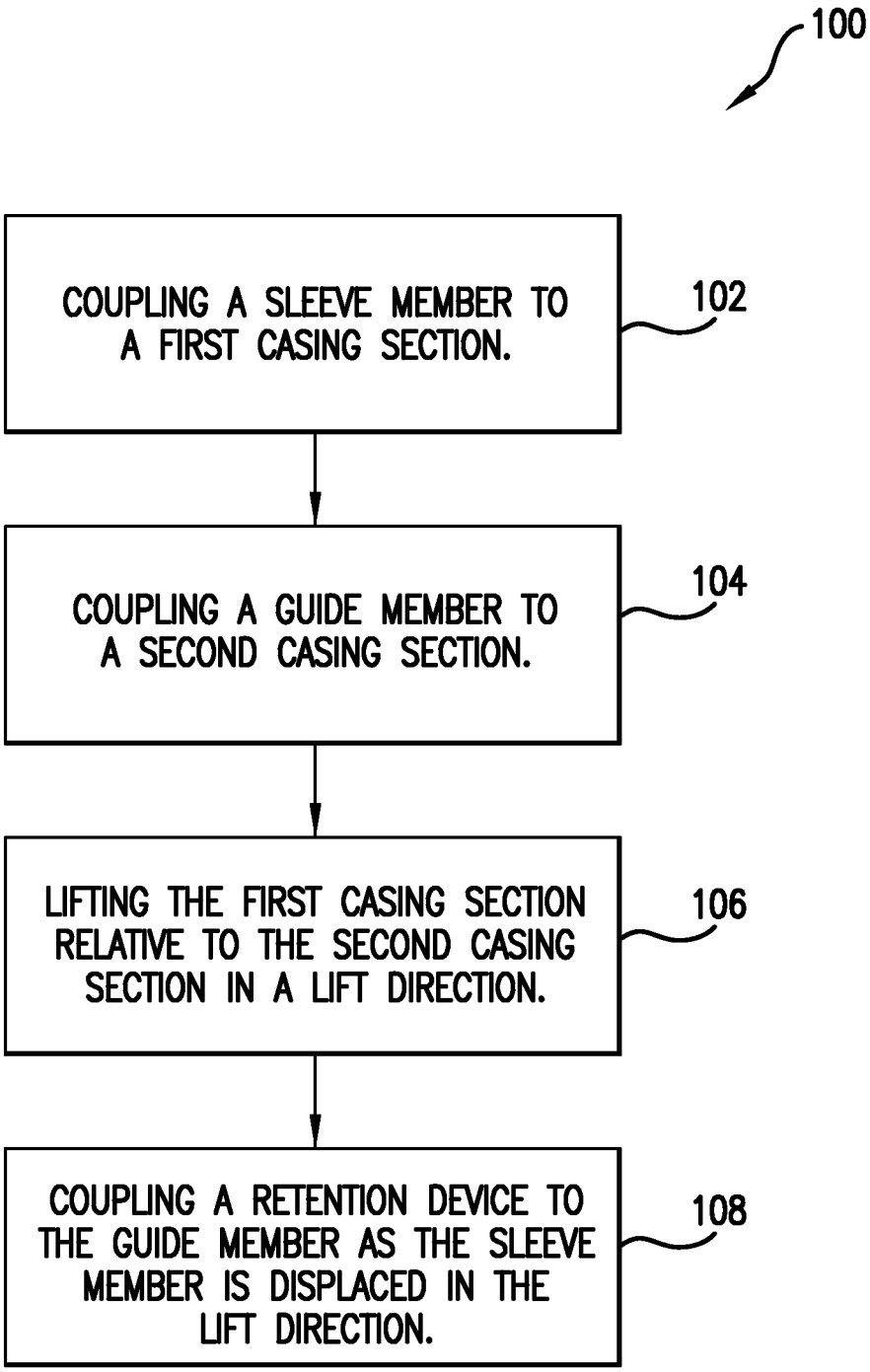
FIG. 6 illustrates a flow diagram of one embodiment of a method for lifting a first casing section relative to a second casing section.

Referring now to FIG. 6, there is illustrated a flow diagram of one embodiment of a method 100 for lifting the first casing section 12 relative to the second casing section 14. As shown, the method 100 may generally include coupling the sleeve member to the first casing section 102, coupling the guide member to the second casing section 104, lifting the first casing section relative to the second casing section in a lift direction 106 and coupling a retention device to the guide member as the sleeve member is displaced in the lift direction 108. It should be appreciated that, although the various method elements 102, 104, 106, 18 of the disclosed method 100 are illustrated in a particular order in FIG. 6, the elements 102, 104, 106, 108 may generally be performed in any sequence and/or order consistent with the disclosure provided herein.

Additionally, in one embodiment, the method 100 may include adjusting a position of the retention device 82, 84 on the guide member 60 as the sleeve member 62 is displaced in the lift direction.

Moreover, in another embodiment, the method 100 may include inserting at least a portion of the retention device 82, 84 within one of the plurality of openings 86, 88 defined in the guide member 60 as the sleeve member 62 is displaced in the lift direction. In such an embodiment, the method 100 may also include moving the retention device 82, 84 to one of plurality of openings 86, 88 disposed adjacent to the bottom end 90 of the sleeve member 62 as the sleeve member 62 is displaced in the lift direction.

In a further embodiment, the method 100 may include mounting at least one support member 38, 40, 42, 44 between the first casing section 12 and an adjacent casing section 14, 16, 18.

Additionally, in another embodiment, the method 100 may include installing a travel beam 46 for translating the first casing section 12 in the axial direction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for lifting a first casing section relative to a second casing section, the system comprising:

a guide member configured to be coupled to the second casing section so as to generally extend lengthwise in a lift direction of the first casing section, said guide member defining a plurality of openings, said plurality of openings including a first set of openings and a second set of openings, said first set of openings being defined in said guide member so as to be circumferentially offset from said second set of openings;

a sleeve member movably disposed on said guide member, said sleeve member being configured to be coupled to the first casing section such that said sleeve member is displaced in said lift direction as the first casing section is lifted; and a retention device configured to be coupled to said guide member at differing locations along a length of said guide member, at least a portion of said retention device being configured to be received within one of said plurality of openings.

2. The system of claim 1, wherein said plurality of openings is spaced apart along said length of said guide member.

3. The system of claim 1, wherein said guide member and said sleeve member each have a tubular configuration.

4. The system of claim 1, wherein said retention device comprises at least one shear pin.

5. The system of claim 1, further comprising a lifting mechanism configured to lift the first casing section in said lift direction.

6. The system of claim 5, wherein said lifting mechanism comprises at least one raising device.

7. The system of claim 1, further comprising a guide flange extending from said guide member and a mounting plate attached to the second casing section, said guide flange being configured to be attached to said mounting plate.

8. The system of claim 7, wherein said mounting plate is attached to a horizontal flange of the second casing section.

9. The system of claim 1, further comprising a sleeve flange extending from said sleeve member and a mounting plate attached to the first casing section, said sleeve flange being configured to be attached to said mounting plate.

10. The system of claim 9, wherein said mounting plate is attached to a horizontal flange of the first casing section.

11. The system of claim 1, wherein the first casing section comprises a first turbine casing section and the second casing section comprises a second turbine casing section.

12. A method for lifting a first casing section relative to a second casing section, the method comprising:

coupling a sleeve member to the first casing section;

coupling a guide member to the second casing section, said sleeve member being movably disposed on said guide member, said guide member defining a plurality of openings;

lifting the first casing section relative to the second casing section in a lift direction;

inserting at least a portion of a retention device within one of said plurality of openings as said sleeve member is displaced in said lift direction; and moving said retention device to another opening of said plurality of openings disposed adjacent to a bottom end of said sleeve member as said sleeve member is displaced in said lift direction.

13. The method of claim 12, further comprising mounting at least one support member between said first casing section and an adjacent casing section.

14. The method of claim 12, further comprising installing a travel beam for translating the first casing section in an axial direction.

* * * * *